US006817896B2

(12) United States Patent
Derenthal

(10) Patent No.: US 6,817,896 B2
(45) Date of Patent: Nov. 16, 2004

(54) CABLE CONNECTOR WITH UNIVERSAL LOCKING SLEEVE

(75) Inventor: Brian R. Derenthal, Horseheads, NY (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 10/389,152

(22) Filed: Mar. 14, 2003

(65) Prior Publication Data

US 2004/0180575 A1 Sep. 16, 2004

(51) Int. Cl.[7] ..... H01R 9/05
(52) U.S. Cl. ..... 439/578; 439/584; 439/585
(58) Field of Search ..... 439/578–585

(56) References Cited

U.S. PATENT DOCUMENTS

| | | | |
|---|---|---|---|
| 1,667,485 | A | 4/1928 | MacDonald |
| 3,184,706 | A | 5/1965 | Atkins |
| 3,406,373 | A | 10/1968 | Forney, Jr. |
| 3,668,612 | A | 6/1972 | Nepovim |
| 3,854,003 | A | 12/1974 | Duret |
| 3,907,399 | A | 9/1975 | Spinner |
| 4,280,749 | A | 7/1981 | Hemmer |
| 4,408,822 | A | 10/1983 | Nikitas |
| 4,593,964 | A | 6/1986 | Forney, Jr. et al. |
| 4,600,263 | A | 7/1986 | DeChamp et al. |
| 4,614,390 | A | 9/1986 | Baker |
| 4,640,572 | A | 2/1987 | Conlon |
| 4,717,355 | A | 1/1988 | Mattis |

(List continued on next page.)

FOREIGN PATENT DOCUMENTS

| | | |
|---|---|---|
| DE | 1191880 | 12/1965 |
| DE | 3211008 | 10/1983 |
| GB | 1087228 | 3/1966 |
| GB | 1270846 | 7/1969 |

OTHER PUBLICATIONS

Broadband Library—Spring 2003—p. 43, Stirling Connector.

(List continued on next page.)

*Primary Examiner*—Michael C. Zarroli
(74) *Attorney, Agent, or Firm*—G. Andrew Barger

(57) ABSTRACT

A cable connector is provided for allowing a plurality of varying diameter cables to be coupled to the cable connector via a locking sleeve. The cable connector includes a connector body and a post coupled to the connector body at a secured end that includes a receiving end axially opposite the secured end. The post has an annular lip integrally formed at the receiving end. The cable connector also includes a generally hollow, rigid sleeve adapted to receive the plurality of varying diameter cables therein. The sleeve has an unlocked position and a locked position wherein it is at least partially disposed within the connector body. A forward end is releasably coupled to the connector body and a rearward end is adapted to receive the cable therein. A protrusion is integrally formed within the sleeve and has a leading edge and a trailing edge such that when the cable is inserted into the sleeve and the sleeve is transitioned from the unlocked position to the locked position, at least part of the cable is compressed between the lip of the post and the protrusion. When the sleeve is in the locked position at least part of the cable is forced away from the post toward the sleeve at the lip, and forced away from the sleeve toward the post at the protrusion, crimping of the cable.

20 Claims, 4 Drawing Sheets

U.S. PATENT DOCUMENTS

| | | | | | |
|---|---|---|---|---|---|
| 4,789,355 | A | | 12/1988 | Lee | |
| 4,834,675 | A | | 5/1989 | Samchisen | |
| 4,902,246 | A | | 2/1990 | Samchisen | |
| 4,973,265 | A | | 11/1990 | Heeren | |
| 5,002,503 | A | | 3/1991 | Campbell et al. | 439/578 |
| 5,024,606 | A | | 6/1991 | Ming-Hwa | 439/578 |
| 5,161,993 | A | | 11/1992 | Leibfried, Jr. | |
| 5,207,602 | A | * | 5/1993 | McMills et al. | 439/836 |
| 5,354,217 | A | | 10/1994 | Gabel et al. | |
| 5,435,745 | A | | 7/1995 | Booth | |
| 5,466,173 | A | | 11/1995 | Down | 439/584 |
| 5,470,257 | A | | 11/1995 | Szegda | |
| 5,571,028 | A | | 11/1996 | Szegda | |
| 5,586,910 | A | | 12/1996 | Del Negro et al. | |
| 5,620,339 | A | | 4/1997 | Gray et al. | |
| 5,632,651 | A | | 5/1997 | Szegda | 439/578 |
| 5,879,191 | A | | 3/1999 | Burris | |
| 5,967,852 | A | | 10/1999 | Follingstad et al. | 439/675 |
| 5,975,951 | A | | 11/1999 | Burris et al. | 439/585 |
| 5,997,350 | A | | 12/1999 | Burris et al. | 439/585 |
| 6,241,553 | B1 | | 6/2001 | Hsia | |
| 6,530,807 | B2 | * | 3/2003 | Rodrigues et al. | 439/578 |
| 6,648,683 | B2 | * | 11/2003 | Youtsey | 439/578 |

OTHER PUBLICATIONS

Broadband Library—Spring 2003—p. 51, PCT International Connector.

* cited by examiner

CABLE CONNECTOR WITH UNIVERSAL LOCKING SLEEVE

FIELD OF THE INVENTION

In general the present invention relates to cable connectors and, in particular, to a cable drop connector having a universal locking sleeve for allowing a plurality of cable waving varying diameters to be coupled to the cable connector.

BACKGROUND

Present cable television, broadband Internet, and satellite systems employ three primary types of cable. The cable commonly referred to as "standard" cable has a center conductor, an inner dielectric encasing the center conductor, a layer of foil surrounding the inner dielectric, a braided shield encasing the foil, and an outer dielectric called the "jacket." The second type of cable is called the "tri-shield" and consists of a center conductor, an inner dielectric encasing the center conductor, a first layer of foil surrounding the inner dielectric, a braided shield encasing the foil, a second layer of foil surrounding the braided shield, and an outer jacket. The third type of cable is called the "quad-shield" and comprises a center conductor, an inner dielectric encasing the center conductor, a first layer of foil surrounding the inner dielectric, a first braided shield encasing the first layer of foil, a second layer of foil surrounding the first braided shield, a second braided shield encasing the second layer of foil, and an outer jacket. Each type of cable has a different diameter due to the presence of the multiple layers of foil and braided shields, and offers various degrees of RF shielding for the center conductor.

In addition, two primary series of cable sizes are used in the industry: Series RG 6 and Series RG 59. Each of these series employs the use of the three types of cable mentioned above. This variation in cable types and series has required cable connector manufacturers to produce a wide variety of connectors of differing sizes to service all the cable types and series.

Current "universal" connectors all require deformation of a non-rigid locking sleeve to annularly compress the various types of cable. This kind of locking sleeve is disadvantageous because uniform annular compression is difficult to obtain when thinned or weakened plastic or metallic material is forced inward under various axial compression forces and differing cable sizes. Therefore, current "universal" connectors may perform poorly in water migration and cable pull out tests and have therefore not been well accepted by the industry.

It would therefore be advantageous from manufacturing, advertising, shipping, and cost perspectives to have a single cable connector to service all Series RG 6 cables and a single connector to service all Series RG 59 cables. Most importantly, it would be desirable to have a universal connector that passes water migration and cable pull out tests for varying diameters of cable while receiving the three different types of cable via the use of a rigid locking sleeve that is not compressed during cable installation.

SUMMARY OF THE INVENTION

The present invention eliminates the above difficulties and disadvantages by providing a cable connector with a rigid locking sleeve for allowing a plurality of varying diameter cables to be coupled to the connector via the locking sleeve.

The cable connector includes a connector body and a post coupled to the connector body at a secured end. The post also includes a receiving end axially opposite the secured end and preferably an annular lip integrally formed at the receiving end.

A sleeve is adapted to receive one of the plurality of varying diameter cables therein. The sleeve has an unlocked and a locked position wherein the sleeve is at least partially disposed within the connector body. The sleeve has a forward end for being inserted into the connector body and a rearward end for receiving the cable therein. A protrusion is at least partially housed within the sleeve and is preferably integrally formed in the sleeve and is annular. In an alternate embodiment the protrusion is an O-ring or non-annular rubber material disposed inside the sleeve. The protrusion can be of the same material and hardness of the sleeve or of a different hardness.

The protrusion preferably includes a leading edge that is complimentary to the lip of the post to ease the sleeve over the lip of the post and cable during transition from the unlocked position to the locked position. The protrusion further includes a trailing edge that can be formed at a complimentary angle to the leading edge. The leading edge may also be disposed at a lesser angle than the trailing edge to ease insertion of the sleeve around the post and cable when transitioned to the locked position.

In the locked position, clearance is provided between the lip and the sleeve to accommodate the plurality of varying diameter cables while sealing the cable connector from environmental elements between the post and the trailing edge of the protrusion by compression crimping the cable. The protrusion is disposed in the connector body apart from the lip so that the cable is crimped instead of the locking sleeve. The protrusion is also disposed toward the secured end of the post when the locking sleeve is in the locked position.

DETAILED DESCRIPTION OF THE PREFERRED EMBODIMENT(S)

Figure 1:
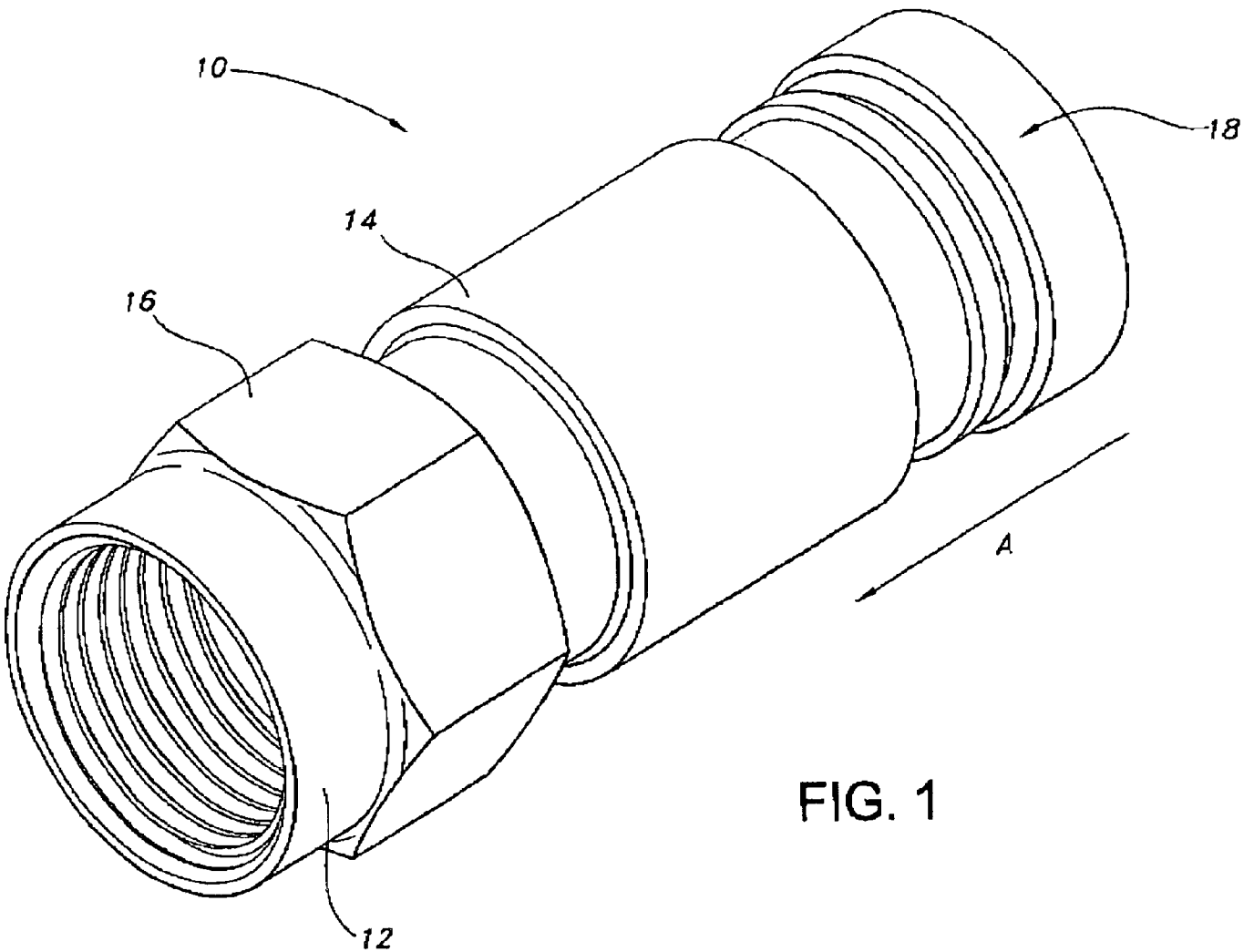
FIG. 1 is a perspective view of a cable connector of the present invention.

The summarized and other features, aspects, and advantages of the present invention will now be discussed in the following detailed description and appended claims, which are to be considered in conjunction with the accompanying drawings in which identical reference characters designate like elements throughout the views.

Full incorporation by reference herein is made to U.S. Pat. No. 6,530,807, entitled: "Coaxial connector having detachable locking sleeve" and having an application filing date of May 9, 2001, which claims priority to U.S. Provisional Application No. 60/202,972 filed May 10, 2000.

Shown in FIG. 1 is a cable connector 10, which is preferably a cable drop connector for terminating a cable TV, satellite dish, or broadband Internet cable to a device such as a television of the present invention.

Connector 10 includes two major components, a connector body 12 and a rigid locking sleeve 18 detachably coupled to body 12. Body 12 is an elongate generally cylindrical conductive member typically formed of metal, preferably brass. Body 12 includes an annular collar 14 for accommodating a coaxial cable therein and an annular nut 16 rotatably coupled to collar 14 for providing mechanical attachment of the connector 10 to an external device such as a television. Interposed between collar 14 and nut 16 is a fixed annular post 36 that axially extends into collar 14. A resilient sealing O-ring 38 is positioned between collar 14 and nut 16 at the rotatable juncture thereof to provide a seal. A portion of nut 16 is internally threaded for permitting screw attachment of body 12 to the external device. As will be described in further detail below, the post 36 and the collar 14 define an annular chamber for accommodating at least a layer of foil 46, and a braided shield 48 of the inserted coaxial cable, as shown in FIGS. 2–4.

Locking sleeve 18 is a generally cylindrical member formed of rigid material that is preferably a synthetic plastic such as an acetate resin. As further shown in FIGS. 2–4, locking sleeve 18 includes a flared rearward end 54 through which cable 40 may be inserted. Opposite rearward end 54 is a forward end 56 that is insertable into collar 14. The post 36 preferably includes an annular lip 28 integrally formed adjacent the forward end 56 of the locking sleeve 18. The function of the annular lip 28 will be discussed in greater detail below.

An O-ring 20 is annularly disposed about the locking sleeve 18 to prevent environmental elements from entering the connector 10 between the annular collar 14 and the locking sleeve 18. The forward end 56 of locking sleeve 18 and the collar 14 include cooperative detent structure that allows for the detachable, re-attachable connection of locking sleeve 18 to body 12. Furthermore, connector 10 is designed such that locking sleeve 18 is axially moveable towards nut 16 from an unlocked position 60 shown in FIGS. 2 and 4, which loosely retains the cable 40 within connector body 12, to a forward locked position 62 shown in FIG. 3, which couples or secures the cable 40 to connector body 12.

Figure 2:
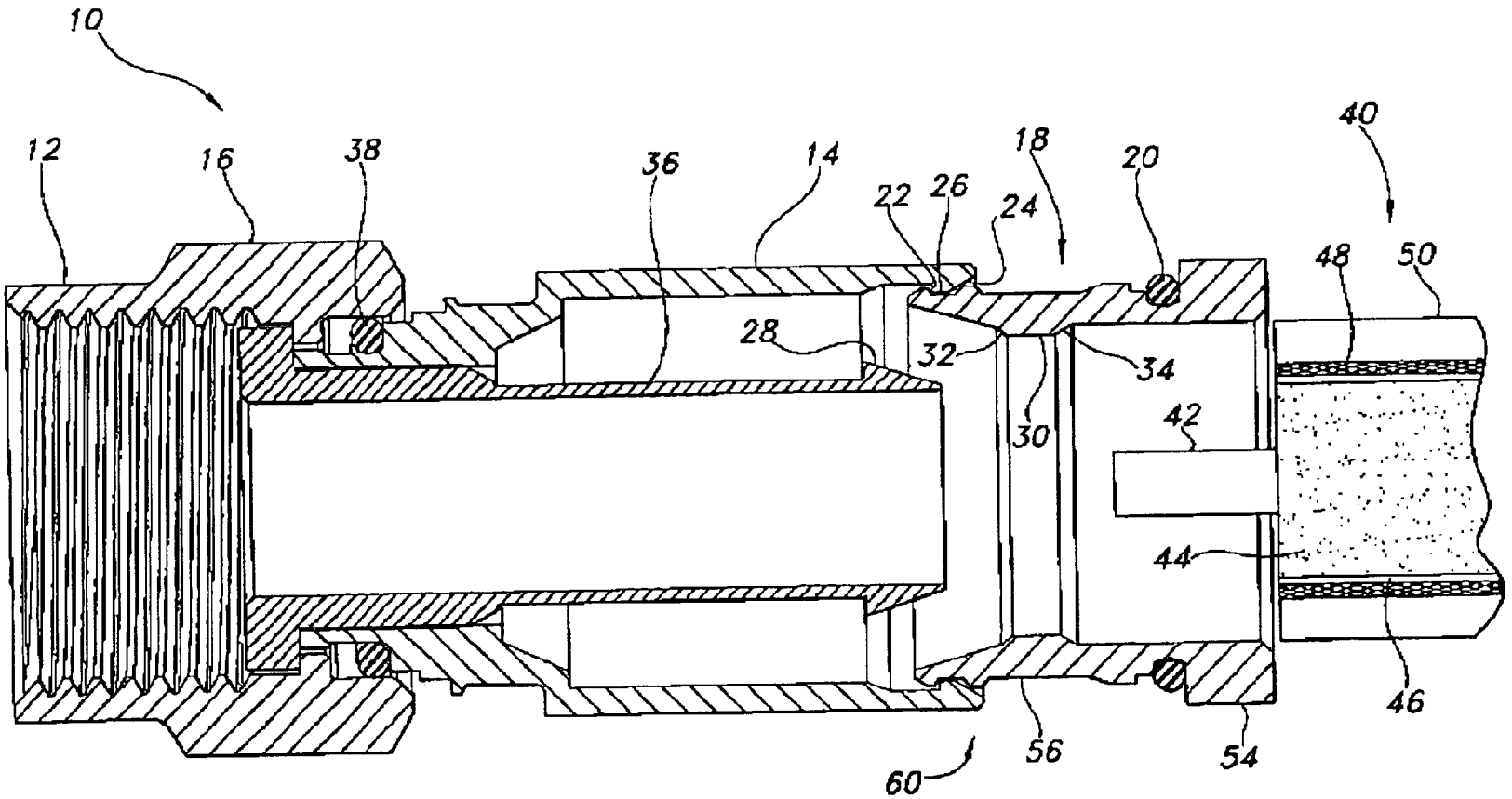
FIG. 2 is a cutaway view of the cable connector of the present invention taken along sight line A of FIG. 1 before cable installation.
Figure 3:
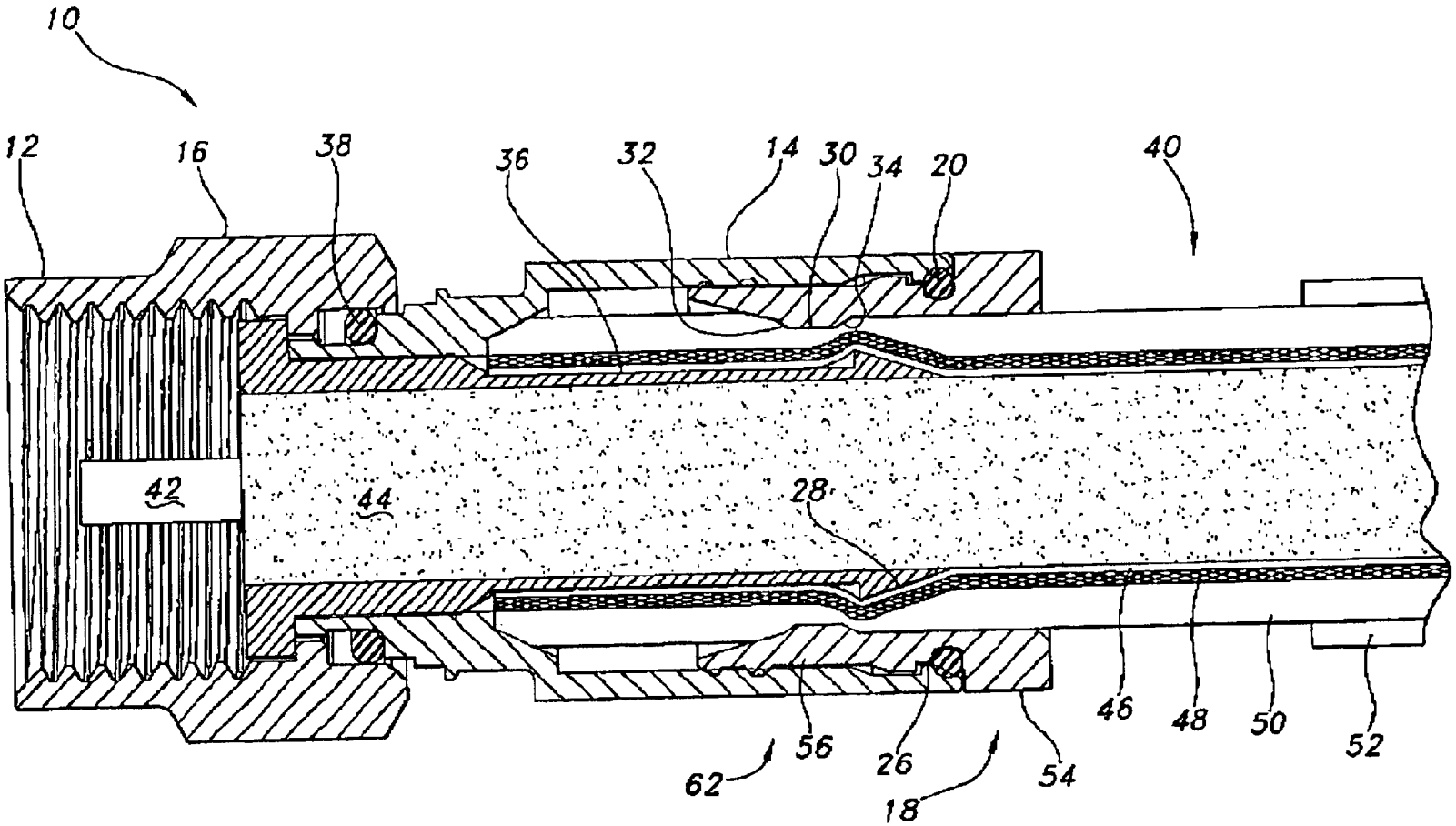
FIG. 3 is a cutaway view of the cable connector of the present invention taken along sight line A of FIG. 1 during cable installation.
Figure 4:
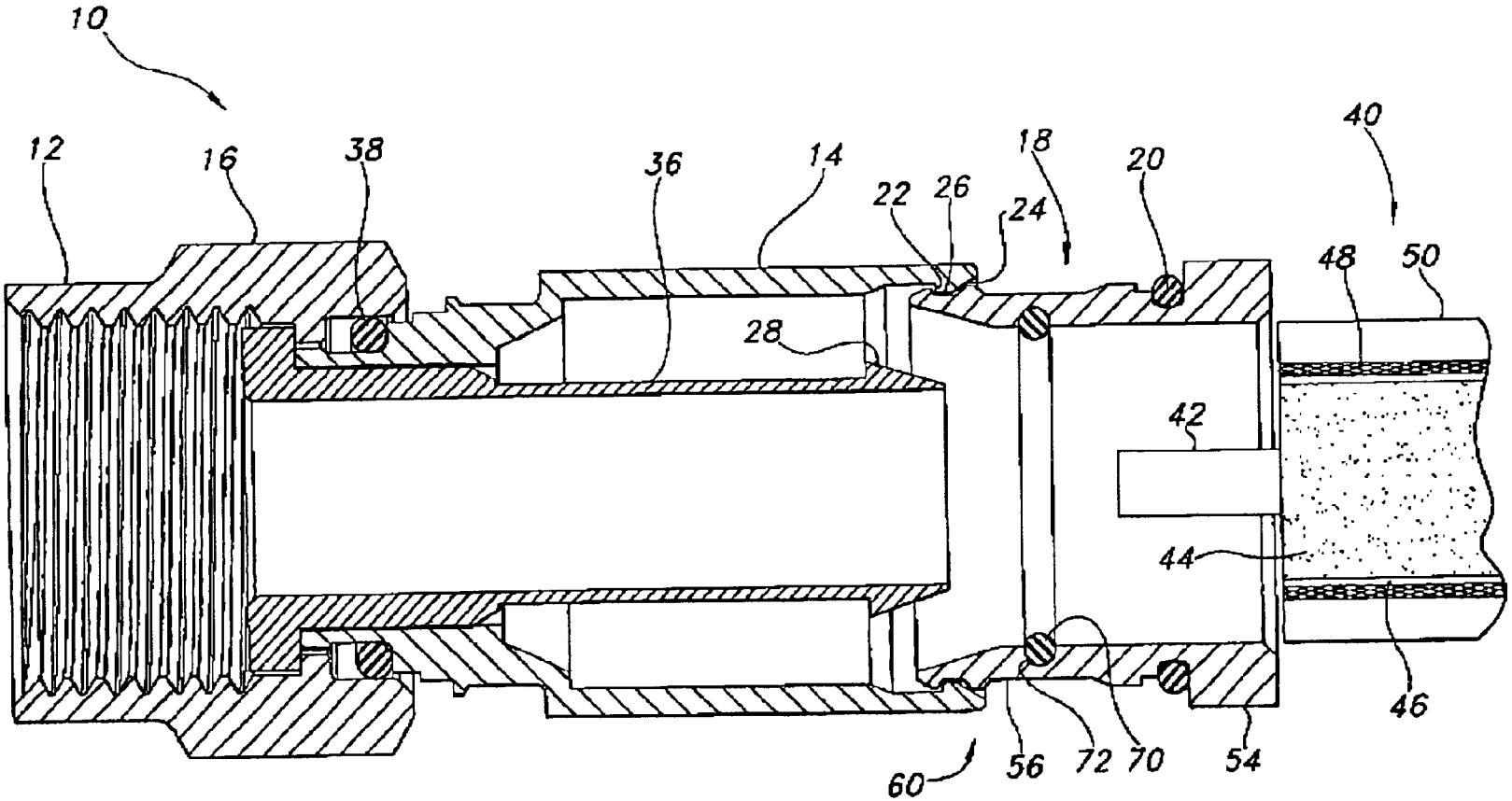
FIG. 4 is a cutaway view of the cable connector of the present invention taken along sight line A of FIG. 1 before cable installation and showing an alternate embodiment.

The connector 10 of the present invention is preferably supplied in the assembled condition shown in FIGS. 2 and 4. In such assembled condition, the coaxial cable 40 is inserted through the rearward end 54 of locking sleeve 18 and through connector body 12. The locking sleeve 18 may be moved from the unlocked position 60 loosely retaining the cable 40 to the locked position 62 that is axially forward thereby locking the cable 40 to the connector body 12 and preventing cable 40 from being pulled out. At no time does the rigid locking sleeve 18 compress axially or deform inwardly. It is, however, contemplated that the locking sleeve 18 may be detached from connector body 12, so as to allow the coaxial cable 40 to be inserted directly into the annular collar 14 of the connector body 12 after the locking sleeve 18 is slid up the cable 40. Thereafter, the locking sleeve 18 that has been placed around the cable 40 may be reattached to the annular collar 14 of body 12 where it can be moved from the unlocked position 60 to the locked position 62 locking the cable 40 to the connector body 12. The sleeve 18 is at least partially disposed within the connector body 10 in the locked position 62.

The cable 40 shown in FIGS. 2–4 is a "tri-shield" cable that consists of a center conductor 42, an inner dielectric 44 encasing the center conductor 42, a first layer of foil 46 surrounding the inner dielectric 44, a braided shield 48 encasing the first layer of foil 46, a second layer of foil 50 surrounding the braided shield 48, and an outer dielectric jacket 52. It is appreciated that the "tri-shield" cable 40 is only exemplary and that the present connector 10 will operate with a plurality of cables of varying diameter, such as standard cables only having one braided shield and one layer of foil, or a "quad-shield" cable.

During preparation of cable 40, the layers of material surrounding the center conductor 42 are stripped back by the installer such that the center conductor 42 extends further into the connector 10. Particular installations may require that jacket 52 is not striped back prior to insertion into connector 10. The braid, foil and jacket layers are also stripped back from the inner dielectric 44. Likewise, the outer jacket 52 is preferably stripped back from the foil and braid layers. As previously stated, the present locking sleeve 18 allows for a plurality of varying diameter cables 40 to be coupled to the connector 10 via the locking sleeve 18.

In particular, the locking sleeve 18 has a forward end 56 for being inserted into the connector body 12 and a rearward end 54 for receiving the cable 40 therein. A flange 26 is formed within the collar 14 of the connector 10 that fits between a first outer annular ring 22 and a second outer annular ring 24 disposed on the outside of locking sleeve 18 in the unlocked position 60, as shown in FIGS. 2 and 4.

Fundamental to the present invention is a protrusion 30 that is at least partially housed within the sleeve 18 and is preferably integrally formed in the sleeve 18 and formed of the same material as the sleeve 18, each being rigid. Thus, in the preferred embodiment there is no compression of the sleeve 18 or of the protrusion 30 such that only the cable is crimped in an annular, uniform fashion. In an alternate embodiment, as shown in FIG. 4, the protrusion is an O-ring 72 disposed in recess 70 on the inside of sleeve 18. The protrusion 30 can also be made of a rubber or thermo-formed plastic material disposed inside the sleeve 18 and formed therewith. The protrusion 30 can be of the same material and hardness as the sleeve 18 or of a different hardness. It is appreciated that a softer material such as rubber for the integrally formed protrusion 30, or O-ring would simultaneously provide ease of transition of the sleeve 18 from the unlocked position 60 to the locked position 62 while providing better annular compression of the cable 40 without tearing or ripping a foil or braid layer of material.

As shown in FIGS. 2–4, the leading edge 32 of the protrusion 30 is preferably complimentary to the lip 28 of the post 36 to ease the sleeve 18 over the lip 28 of the post 36 and cable 40 during transition from the unlocked position 60 to the locked position 62. During installation of the cable 40 into the connector 10, the post 36 is inserted between the dielectric layer 44 and the first layer of foil 46 of the cable 40 thereby separating the dielectric layer 44 from the first layer of foil 46. The protrusion 30 further includes a trailing edge 34. As shown in FIGS. 2 and 3, and the leading edge 32 and trailing edge 34 can be formed at complimentary angles or at any combination of angles to ease transition to the locked position 62 while providing an environmental seal crimp or compression point in cable 40 between the trailing edge 34 and post 36. The leading edge 32, may be disposed at a small angle less than forty-five degrees to ease insertion of the sleeve 18 around the post 36 and cable 40 when transitioned to the locked position 62.

When sleeve 18 is in the locked position 62, as shown in FIG. 3, sufficient clearance is provided between the lip 28 and the sleeve 18 to accommodate the plurality of varying diameter cables while sealing the connector 10 from environmental elements entering between the post 36 and the trailing edge 34 of the protrusion 30 by annularly crimping the cable 40. In addition, protrusion 30 is axially disposed apart from the lip 28 in the connector body 12 toward the secured end of the post 36. The trailing edge 34 of the sleeve 18 is preferably formed at a forty-five degree angle such that when the sleeve 18 is in the locked position multiple layers of the cable are forced away from the post 36 toward the sleeve 18 while going over the lip 28, and are forced away from the sleeve 18 down toward the post 36 at the trailing edge 34 of the protrusion 30, annularly crimping the cable 40 by compression without deformation of the post 36, sleeve 18, or protrusion 30.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

What is claimed is:

1. A cable connector having for allowing a plurality of varying diameter cables to be coupled to the cable connector via the locking sleeve, the cable connector comprising:

a connector body;

a post coupled to the connector body at a secured end and including a receiving end axially opposite the secured end; and a rigid sleeve adapted to receive one of the plurality of varying diameter cables therein, the sleeve having a locked position wherein the sleeve is at least partially disposed within the connector body, a forward end for being inserted into the connector body and a rearward end for receiving the cable at least partially therein, a rigid protrusion that is at least partially housed within the sleeve such that when the sleeve is in the locked position at least part of the cable is forced away from the post toward the sleeve and forced away from the sleeve toward the post at the protrusion.

2. The cable connector of claim 1 wherein the post includes a lip formed at the receiving end such that when the sleeve is in the locked position at least part of the cable is forced away from the post toward the sleeve at the lip.

3. The cable connector of claim 2 wherein the protrusion is positioned, at least partially, over the lip when the sleeve is in the locked position.

4. The cable connector of claim 1 wherein the protrusion of the sleeve is annular.

5. The cable connector of claim 1 wherein the protrusion is of different hardness than the sleeve.

6. The cable connector of claim 1 wherein the protrusion of the sleeve is an O-ring disposed at least partially within the sleeve.

7. The cable connector of claim 2 wherein the protrusion includes a leading edge having an angle that is complimentary to the lip of the post.

8. The cable connector of claim 1 wherein the protrusion includes a trailing edge and a leading edge at complimentary angles.

9. The cable connector of claim 1 wherein the protrusion includes a trailing edge and a leading edge, the leading edge being disposed at a lesser angle than the trailing edge to ease insertion of the sleeve around the post and cable when transitioned to the locked position.

10. The cable connector of claim 1 wherein the protrusion includes a trailing edge such that clearance is provided between the post and the trailing edge to accommodate the plurality of varying diameter cables while sealing the cable connector from environmental elements between the post and the trailing edge of the protrusion.

11. A cable connector having for allowing a plurality of varying diameter cables to be coupled to the cable connector via the locking sleeve, the cable connector comprising:

a connector body;

a post coupled to the connector body at a secured end and including a receiving end axially opposite the secured end, the post having a lip formed at the receiving end;

a sleeve adapted to receive one of the plurality of varying diameter cables therein, the sleeve having a locked position wherein the sleeve is at least partially disposed within the connector body, a forward end for being inserted into the connector body and a rearward end for receiving the cable at least partially therein, and a protrusion having a trailing edge and a leading edge at complimentary angles, the protrusion being at least partially housed within the sleeve such that when the cable is inserted into the sleeve and the sleeve is transitioned to the locked position at least part of the cable is compressed between the lip of the post and the protrusion, and when the sleeve is in the locked position at least part of the cable is forced away from the post toward the sleeve at the lip and forced away from the sleeve toward the post at the protrusion.

12. The cable connector of claim 11 wherein the protrusion of the sleeve is an O-ring disposed at least partially within the sleeve.

13. The cable connector of claim 11 wherein the protrusion includes a leading edge having an angle that is complimentary to the lip of the post.

14. The cable connector of claim 11 wherein the protrusion is annular.

15. The cable connector of claim 11 wherein the protrusion includes a trailing edge and clearance is provided between the lip and the sleeve to accommodate the plurality of varying diameter cables while sealing the cable connector from environmental elements between the post and the trailing edge of the protrusion.

16. A cable connector for allowing a plurality of varying diameter cables to be coupled to the cable connector via the locking sleeve, the cable connector comprising:

a connector body;

a post coupled to the connector body at a secured end and including a receiving end axially opposite the secured end, the post having an annular lip integrally formed at the receiving end;

a generally hollow sleeve adapted to receive the plurality of varying diameter cables therein, the sleeve having an unlocked position and a locked position wherein the sleeve is at least partially disposed within the connector body, a forward end releasably coupled to the connector body and a rearward end for receiving the cable therein, a protrusion integrally formed within the sleeve and having a leading edge and a trailing edge such that when the cable is inserted into the sleeve and the sleeve is transitioned from the unlocked position to the locked position at least part of the cable is compressed between the lip of the post and the protrusion, and when the sleeve is in the locked position at least part of the cable is forced away from the post toward the sleeve at the lip, and forced away from the sleeve toward the post at the protrusion, annularly crimping the cable; and wherein the leading edge is disposed at a lesser angle than the trailing edge to ease insertion of the sleeve around the post and cable when transitioned to the locked position.

17. The cable connector of claim 16 wherein the leading edge of the protrusion had an angle that is complimentary to the lip of the post.

18. The cable connector of claim 16 wherein the trailing edge and the leading edge are at complimentary angles.

19. The cable connector of claim 16 wherein the protrusion is annular.

20. The cable connector of claim 16 wherein the protrusion includes a trailing edge and clearance is provided between the lip and the sleeve to accommodate the plurality of varying diameter cables while sealing the cable connector from environmental elements between the post and the trailing edge of the sleeve.

* * * * *